US008187115B2

(12) United States Patent
Bennett et al.

(10) Patent No.: US 8,187,115 B2
(45) Date of Patent: May 29, 2012

(54) SET OF CONSTANT FACE CENTER METAL WOODS

(75) Inventors: Thomas O. Bennett, Carlsbad, CA (US); Gery Zimmerman, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 38 days.

(21) Appl. No.: 12/362,101

(22) Filed: Jan. 29, 2009

(65) Prior Publication Data

US 2010/0190567 A1 Jul. 29, 2010

(51) Int. Cl.
*A63B 53/04* (2006.01)

(52) U.S. Cl. ..... 473/290; 473/314

(58) Field of Classification Search ..... 473/290–291, 473/314

See application file for complete search history.

(56) References Cited

U.S. PATENT DOCUMENTS

| | | | | | |
|---|---|---|---|---|---|
| 4,240,631 | A * | 12/1980 | MacDougall | 473/289 |
| 5,183,255 | A * | 2/1993 | Antonious | 473/314 |
| 5,199,707 | A * | 4/1993 | Knox | 473/314 |
| 5,497,992 | A * | 3/1996 | Ritke | 473/291 |
| 5,601,498 | A * | 2/1997 | Antonious | 473/305 |
| 5,823,887 | A * | 10/1998 | Mikame et al. | 473/290 |
| 5,890,971 | A * | 4/1999 | Shiraishi | 473/291 |
| 6,071,198 | A * | 6/2000 | Nishizawa et al. | 473/291 |
| 6,089,990 | A * | 7/2000 | Kimura | 473/290 |
| 6,319,148 | B1 * | 11/2001 | Tom | 473/290 |
| 7,353,189 | B2 * | 4/2008 | Parasirakis et al. | 705/26.81 |
| 2003/0176232 | A1 * | 9/2003 | Hasebe | 473/291 |
| 2005/0282652 | A1 * | 12/2005 | Brinton et al. | 473/287 |
| 2007/0042832 | A1 * | 2/2007 | Hjaltason | 473/314 |

* cited by examiner

*Primary Examiner* — Stephen L. Blau
(74) *Attorney, Agent, or Firm* — Murphy & King, P.C.

(57) ABSTRACT

Golf equipment including a set of golf clubs having a substantially constant distance from the shaft axis to the central point of the club face for each club in the set. The central point may be the geometric center of the face or the impact point, which may be the same or different.

18 Claims, 8 Drawing Sheets

SET OF CONSTANT FACE CENTER METAL WOODS

FIELD OF THE INVENTION

The present invention generally relates to sets of metal wood golf clubs, and more particularly, to a set of metal wood golf clubs that have a constant face center relative to the shaft axis.

BACKGROUND OF THE INVENTION

In conventional sets of metal wood golf clubs, each club includes a shaft with a club head attached to one end and a grip attached to the other end. The club head includes a face for striking a golf ball. The angle between the face and a vertical plane is called "loft." The set may include multiple clubs of varying loft. Each metal wood has a length that usually decreases through the set as the loft angle for each club head increases.

The length of the club, along with the club head loft and center of gravity impart various performance characteristics to the ball's launch conditions upon impact. For example, a low loft angle club will result in a lower trajectory of the golf ball flight, which typically results in a greater overall distance. Alternatively, a high loft angle club will result in a higher initial trajectory, and typically less overall distance when compared to a lower loft angle club. In certain conditions, such as high winds, it is advantageous for the golfer to use a lower loft angle club to keep the golf ball flight path low and out of the wind. In other conditions, such as hard or dry conditions, the golfer may want to control the distance of the shot by using a club with a high loft angle, which typically results in less roll.

Metal wood golf clubs have previously been designed by keeping the top line fixed and extending the leading edge out or in to change the loft. While this process provides an easy way of manufacturing a set of metal woods, it results in a varied impact point with respect to the shaft axis from club to club. Thus, the golfer must adapt his/her swing and approach to the ball for each club in the set.

Therefore, it is desirable to provide a set of metal wood golf clubs that produce a substantially constant impact point relative to the shaft axis throughout the set. The present invention seeks to address this need in the art.

SUMMARY OF THE INVENTION

In accordance with the present invention, a set of golf club heads is disclosed. The set includes a plurality of club heads. Each club head in the set generally includes a heel, a toe, a face, a top line, a sole, a center of gravity, a geometric center of the face, an impact point, a shaft, and a leading edge and has substantially the same distance between the shaft axis and a predetermined central point on the club face.

The predetermined central point may be either the geometric center of the face or the impact point. The impact point may be aligned with the center of gravity of the clubhead. Alternatively, the impact point may be aligned with the geometric center of the face. The impact point may be located less than about 0.20 inch or less than about 0.15 inch from a horizontal line passing through the face and the center of gravity. As a result of the substantially constant distance between the predetermined central point on the face and the shaft axis, the golfer will not have to adjust his swing significantly when using the various clubs in the set.

For example, in one embodiment, a first club head has a first loft angle and a first predetermined central point. A second golf club head has a second loft angle and a second predetermined central point. While the first loft angle differs from the second loft angle, each club has a first distance D1 equal to the horizontal distance from the shaft axis to the predetermined central points. The first distance is substantially constant for each club in the set. In addition, the ratio of the first distance of the first club to the first distance of the second club in the set may be between about 0.90 and about 1.10, between about 0.95 and about 1.05, or between about 0.98 and about 1.02.

The set may include a third club having a third loft angle that differs from the first and second loft angles. The first distance may vary by less than about 10 percent for each club in the plurality. The loft angles of the clubs in the set may vary from about 8° to about 35°. In addition, the ratio of the first distance for the first club to the first distance of the third club may be between about 0.90 to 1.10.

In one embodiment, each club has a second distance DT equal to the distance from the topline of the club head at the center of the club face to a vertical line passing through the geometric center of the face and a third distance DB equal to the distance between the leading edge at the center of the club face to a vertical line passing through the geometric center of the face. The second distance for each club in the set may increase as the loft angle of the club increases. Also, the third distance for each club in the set may increase as the loft angle of the club increases.

The present invention also relates to a set of golf clubs including a plurality of clubs, wherein each club in the plurality includes a club head including a face, a geometric center of the face, an impact point, a topline, a leading edge, a toe, a heel, a sole, a crown, and a shaft, wherein each club has a first distance D1 equal to the horizontal distance from the shaft axis to the geometric center of the clubface, and wherein the first distance is substantially constant for each club. In one embodiment, the the plurality of clubs includes at least a first club having a first loft angle and a second club having a second loft angle that differs from the first loft angle, wherein the ratio of the first distance of the first club to the first distance of the second club in the set is between about 0.90 and about 1.10.

In this aspect of the invention, the ratio of the first distance for the first club to the first distance of the second club may be between about 0.95 and about 1.05. In one embodiment, the ratio of the first distance for the first club to the first distance of the second club is between about 0.98 and about 1.02. Each club may have a loft angle where the loft angles in the set vary from about 8° to about 35°.

In addition, each club may have a second distance DT equal to the distance from the topline of the club head at the center of the club face to a vertical line passing through the geometric center of the face and a third distance DB equal to the distance between the leading edge at the center of the club face to a vertical line passing through the geometric center of the face, and wherein the second distance for each club in the set increases as the loft angle of the club increases. In one embodiment, the third distance for each club in the set increases as the loft angle of the club increases.

The present invention is also directed to a set of golf clubs including a plurality of golf clubs, wherein each club in the plurality of golf clubs includes a club head including face, a geometric center of the face, an impact point, a topline, a leading edge, a toe, a heel, a sole, a crown, a shaft, and center of gravity, wherein the impact point is aligned with a center of gravity of the club, wherein each club has a first distance D1 equal to the horizontal distance from the shaft axis to the impact point, and wherein the first distance varies by less than about 10 percent for each club in the plurality. In one embodiment, the impact point is located less than about 0.20 inch from a horizontal line passing through the face and the center of gravity. For example, the impact point may be located less than about 0.15 inch from a horizontal line passing through the face and the center of gravity.

In this aspect of the invention, the plurality of golf clubs includes a first club having a first loft angle and a second club having a second loft angle that differs from the first loft angle. In one embodiment, the ratio of the first distance for the first club to the first distance of the second club is between about 0.90 to 1.10. In another embodiment, the first distance for the first club varies by about 10 percent or less from the first distance of the second club.

In one embodiment, the plurality of golf clubs further includes a third club having a third loft angle that differs from the first and second loft angles. In this aspect, the ratio of the first distance for the first club to the first distance of the third club may be between about 0.90 to 1.10. In addition, the third loft angle may be greater than the second loft angle, which may be greater than the first loft angle, and the ratio of the first distance of the first club to the second club and the ratio of the second club to the third club may vary by less than about 10 percent.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

The present invention is directed to a set of golf clubs with a constant face center. In particular, contrary to existing sets of golf clubs with multiple loft angles, the clubs of the present invention vary in loft through the adjustment of the rotation of the face about a central point on the face that is fixed relative to the shaft axis. As a result, the leading edge of each of the clubs may vary throughout the set. In addition, the top line also varies from loft to loft.

Generally, the loft angle for the clubs in the set may range from about 80 to about 40°. In one embodiment, the range of loft angles in the set of clubs is from about 8° to about 35°. In yet another embodiment, the range of loft angles in the set of clubs is from about 8° to about 32°.

Figure 1:
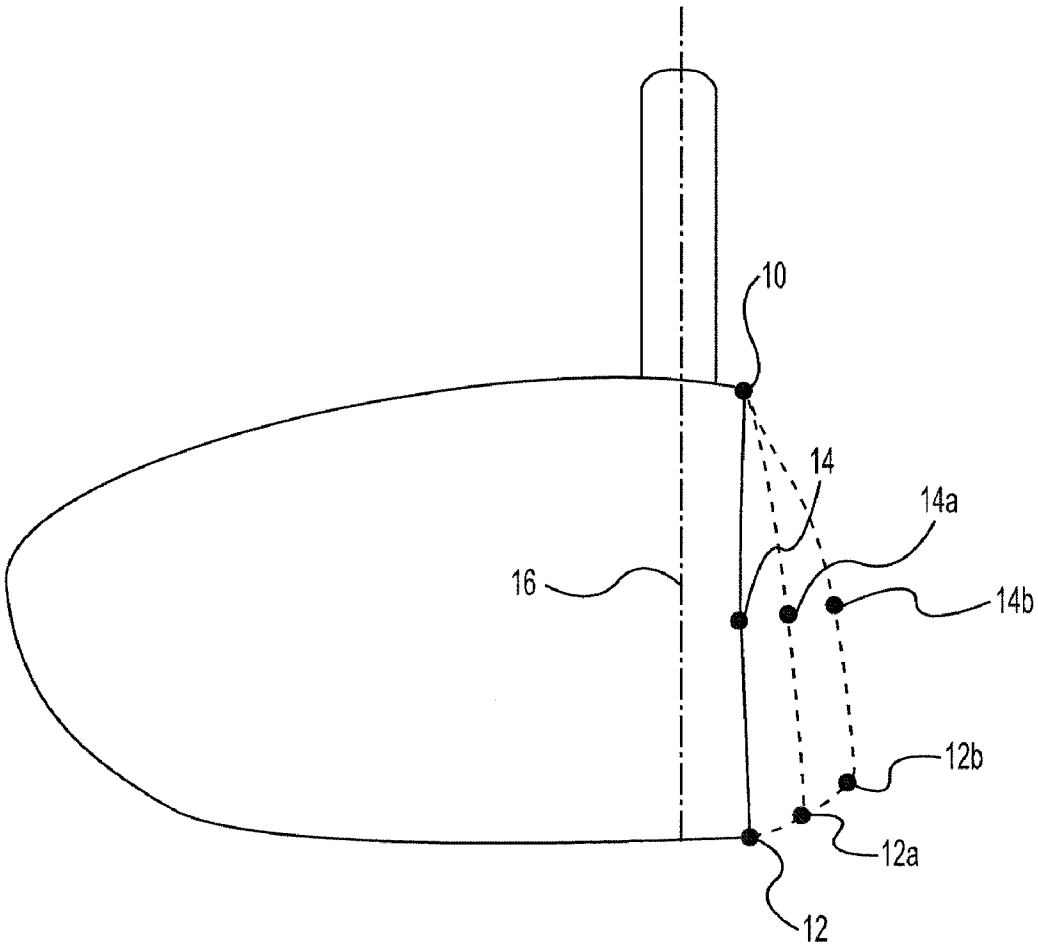
FIG. 1 (PRIOR ART)
FIG. 1 is a side cross sectional view of a set of golf club heads from the prior art.

FIG. 1 shows a general cross section of a set of prior art golf clubs, where each club generally has a different face center, but the same top line. Typically, to achieve varying loft angles throughout a set of clubs, a point at the topline 10 is held constant. In order to create a set of clubs with varying loft angles, a point at the leading edge 12 would have to be extended away from the face as represented by points 12*a* and 12*b*. As a result, the center of the face 14 also has to be extended outward, as represented by points 14*a* and 14*b*. This results in a difference in distance from the center of the club face (14, 14*a*, 14*b*) to the shaft axis 16 for each club. This distance may vary by as much as about 2% to about 5%.

Figure 2:
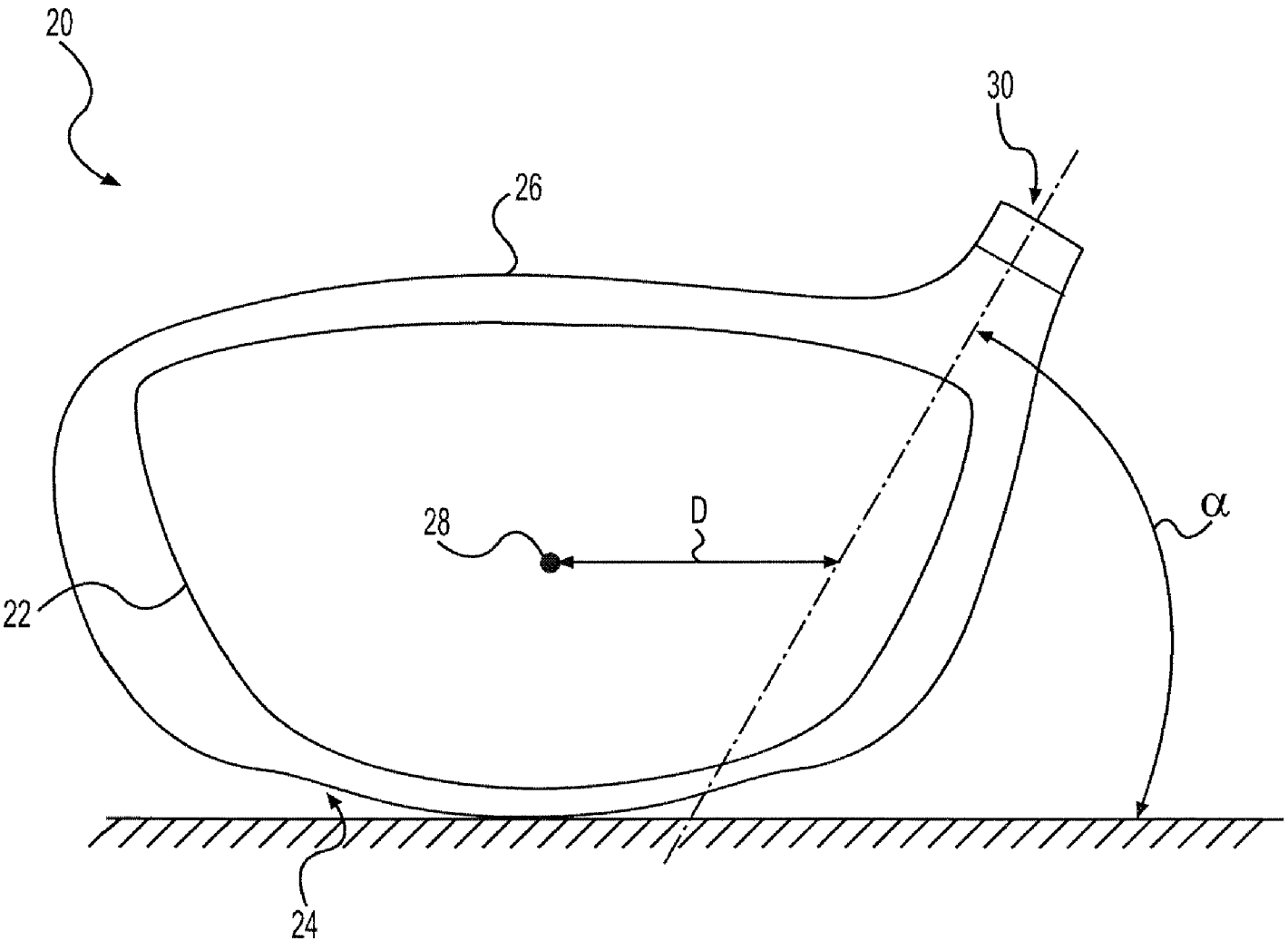
FIG. 2 is a front view of the golf club head of the present invention.

FIG. 2 shows a front view of a metal wood golf club 20 according to the present invention. The club head has a face 22, a sole 24, a topline 26, a geometric center of the face 28, and a shaft axis 30. The distance D is equal to the horizontal distance from the geometric center of the face 28 to the shaft axis when grounded at the address position.

Figure 3:
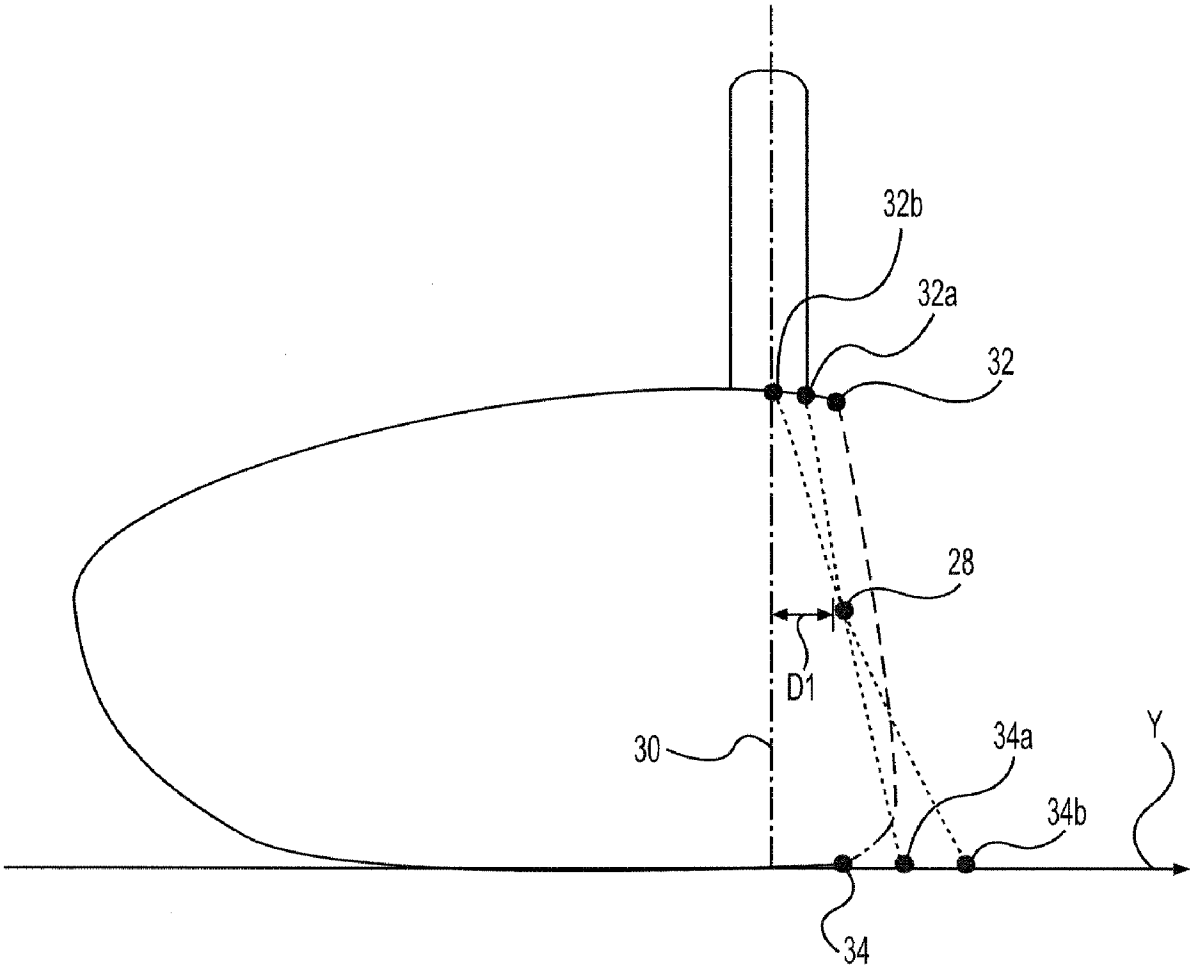
FIG. 3 is a side cross sectional view of a set of golf club heads of the present invention according to an embodiment of the invention.

FIG. 3 shows a cross section of a set of clubs in accordance with the present invention. The geometric center of the face 28 for each club in the set is at a substantially constant distance from the shaft axis 30 throughout the set; however, a point on the topline 32 varies with an increase in loft angle for the various clubs in the set. For example, as loft angle increases, the topline 32 is moved back toward the rear of the club (in the negative y-direction) as illustrated by points 32*a* and 32*b*. Also, because the geometric center of the face 28 is constant, the leading edge 34 is extended outward away from the face (in the positive y-direction) as the loft angle increases, which is represented by points 34*a* and 34*b*.

As shown in FIG. 3, the distance between the geometric center of the face and the shaft axis is substantially similar. Three clubs with varying loft angles are shown in FIG. 3, although more clubs may be included in the set. A first club in the set, i.e., the club with the lowest loft angle, is represented by the locations on the topline 32, geometric center of the face 28, and leading edge 34. Length D1 generally represents the distance from the shaft axis 30 to the geometric center of the face 28 for each club in the set. D1 is substantially constant for each club in the set. As used herein, "substantially constant" generally means that the particular measurement value varies by less than about 20 percent, preferably less than about 10 percent, and more preferably less than about 5 percent throughout the clubs in the set. In this particular aspect, D1 preferably varies about 20 percent or less, preferably about 10 percent or less, and more preferably about 5 percent or less. In one embodiment, D1 varies throughout the clubs in the sets by about 4 percent or less, preferably about 3 percent or less, and more preferably about 2 percent or less. In another embodiment, D1 varies throughout the set by about 1 percent or less, preferably about 0.5 percent or less, and even more preferably about 0.025 percent or less. In yet another embodiment, D1 is essentially identical throughout the set. As used herein, "essentially identical" means that the particular measurement, in this case D1, varies by less than about 0.01 percent.

In other words, the ratio of D1 for a first club in the set to a second club in the set may range, for example, from about 0.90 to about 1.10, preferably from about 0.95 to about 1.05, and more preferably about 0.98 to about 1.02. For this particular club, $D1_1$ will be used to represent the distance from the shaft axis 30 to the geometric center of the face 28.

A second club with an intermediate loft angle (higher than the first club) is represented by the locations on the topline 32*a*, geometric center of the face 28, and leading edge 34*a*. A length $D1_2$ is the distance from the shaft axis 30 to the geometric center of the face 28 for the second club in the set. As previously set forth, D1 is substantially constant throughout the set. As such, $D1_2$ does not vary more than about 20 percent from $D1_1$. In one embodiment, $D1_2$ varies from $D1_1$ by about 10 percent or less. In another embodiment, $D1_2$ varies from $D1_1$ by about 5 percent or less, more preferably about 4 percent or less, and even more preferably about 2 percent or less. The ratio of $D1_1$ to $D1_2$ preferably ranges from about 0.95 to about 1.05, more preferably from about 0.98 to about 1.02, and most preferably from about 0.99 to about 1.00.

The third club in the set, i.e., the club with the highest loft angle in the set shown in FIG. 3, is represented by the locations on the topline 32*b*, geometric center of the face 28, and leading edge 34*b*. A length $D1_3$ is the distance from shaft axis 30 to the geometric center of the face 28 for the third club in the set. As with the previous two clubs, the difference between $D1_3$ and $D1_1$ and/or $D1_2$ is preferably minimal, i.e., the ratio of $D1_3$ to $D1_2$ and/or $D1_1$ is preferably between about 0.90 and about 1.10, more preferably between about 0.95 and about 1.05, and even more preferably between about 0.98 and about 1.02. In one embodiment, any variations between $D1_1$, $D1_2$, and $D1_3$ are independently less than about 4 percent, more preferably less than about 3 percent, and even more preferably less than about 2 percent. In another embodiment, any variations between $D1_1$, $D1_2$, and $D1_3$ are independently less than about 0.5 percent, more preferably less than about 0.025 percent, and even more preferably less than about 0.01 percent.

As previously discussed, the prior art golf clubs generally hold a point on the topline constant while varying the central point in order to achieve different lofts throughout the set. However, the present invention allows different points on the topline throughout a set. For example, a first club may have a first point on a topline that is closer in proximity to a vertical line passing through the geometric center of the face than a second loft with a higher loft. For simplicity, only three clubs with varying loft angles are shown in FIG. 4 to further demonstrate the varying topline in a set of clubs according to the invention, although it is understood that more clubs may be included in the set.

Figure 4:
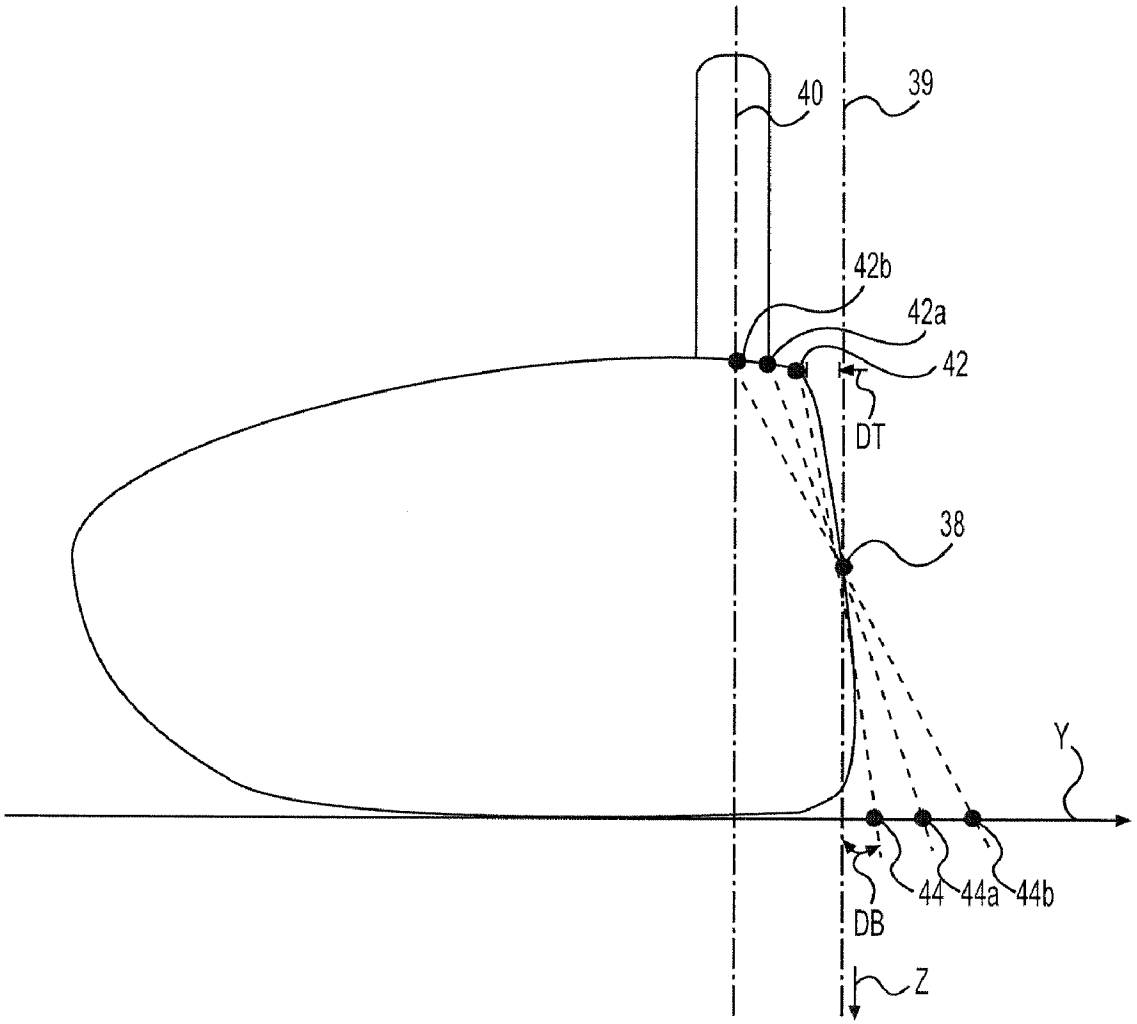
FIG. 4 is a side cross sectional view of a set of golf club heads of the present invention according to an embodiment of the invention.

In particular, as shown in FIG. 4, the distance between the topline 42, 42*a*, and 42*b* to a vertical line 39 passing through the geometric center of the face 38 increases in the negative y-direction as the loft angle increases. A length DT is the distance from the vertical line 39 passing through the geometric center of the face 38 to the topline point 42. For example, for a first club in the set, i.e., the club with the lowest loft angle, the length $DT_1$ is the smallest in the set. The DT length for the second club in the set ($DT_2$) is greater than $DT_1$ since the second club, represented by topline point 42*a* and leading edge 44*a*, has a larger loft than the first club in the set. Similarly, the third club in the set, represented by the club having topline point 42*b* and leading edge 44*b*, has an even larger loft and, thus, a larger distance ($DT_3$) from the vertical line 39 passing through the geometric center of the face 38 to topline 42*b* for the club with the highest loft angle. Thus, the relationship between the distances for the three clubs may be expressed as $DT_1<DT_2<DT_3$.

An alternative method for describing the varying top lines of the club set is in relation to the shaft axis. As shown in FIG. 4, the distance from shaft axis 40 to the topline 42, 42*a*, and 42*b* increases as the loft angle of the club decreases.

Similarly, the distance from the leading edge 44, 44*a*, 44*b* to the vertical line 39 passing through the geometric center of the face 38 (generally referred to as DB) increases in the positive y-direction as the loft angle increases for each club in the set. For example, a length $DB_1$ is the distance from the vertical line 39 passing through the geometric center of the face 38 to leading edge 44 for a first club in the set club with the lowest loft angle. Length $DB_2$ is the distance from a vertical line passing through the geometric center of the face 38 to leading edge 44*a* for a club with an intermediate loft angle. A length $DB_3$ is the distance from a vertical line passing through the geometric center of the face 38 to leading edge 44*b* for the club with the highest loft angle. Thus, length $DB_1$ is less than length $DB_2$, which is less than length $DB_3$, or $DB_1<DB_2<DB_3$.

An alternative method for describing the varying leading edges of the club set is in relation to the shaft axis. As shown in FIG. 4, the distance from shaft axis 40 to the leading edge 44, 44*a*, and 44*b* increases as the loft angle of the club increases.

Table 1 shows the DT and DB values of three clubs in an exemplary embodiment of the invention.

TABLE 1

| Club #/Loft Angle | DT (mm) | DB (mm) |
|---|---|---|
| 1/15° | 5.34 | 4.28 |
| 2/17° | 5.99 | 4.95 |
| 3/19° | 6.54 | 5.56 |

Figure 5:
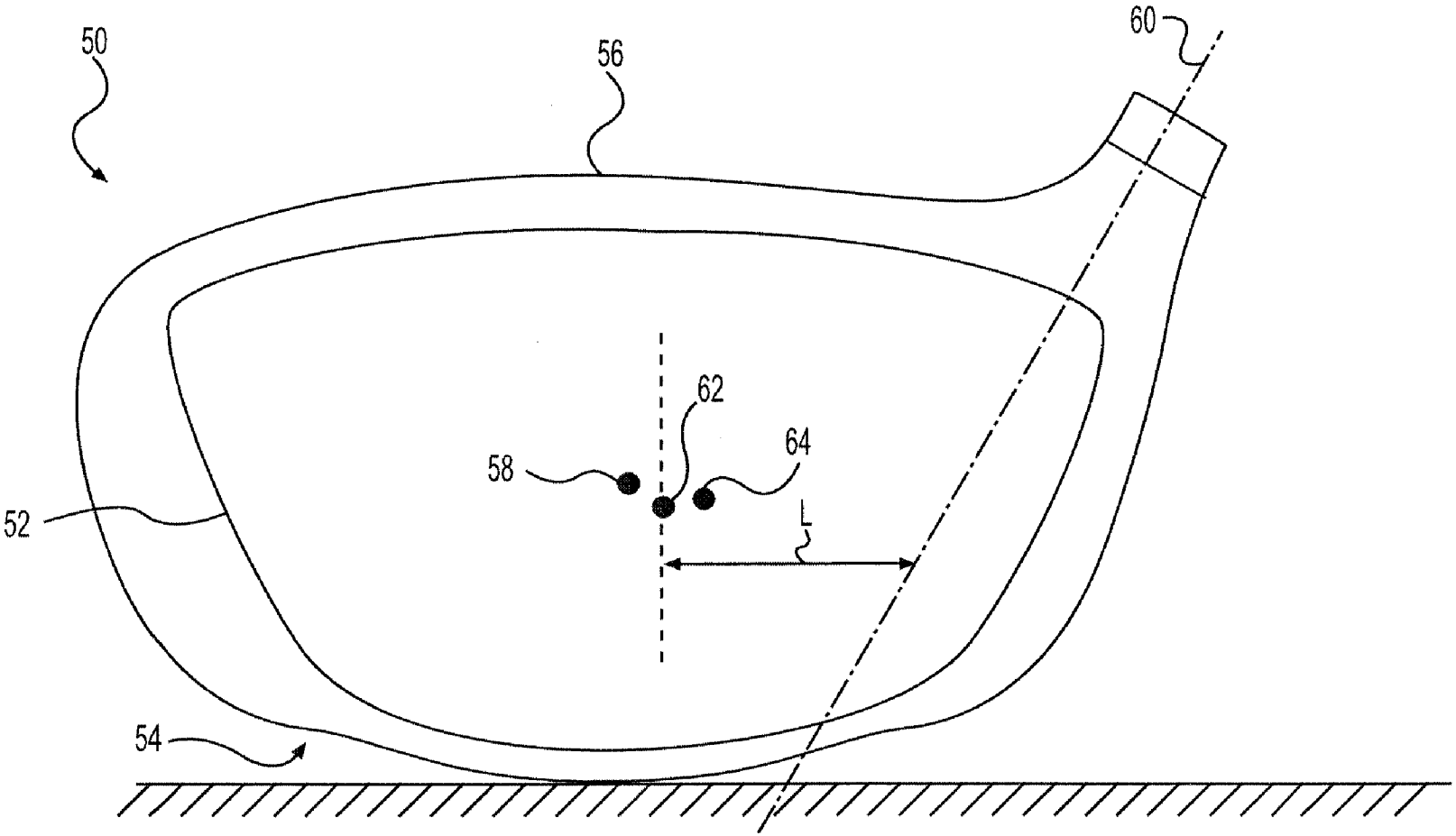
FIG. 5 is a front view of the golf club head of the present invention according to an embodiment of the invention.
Figure 6:
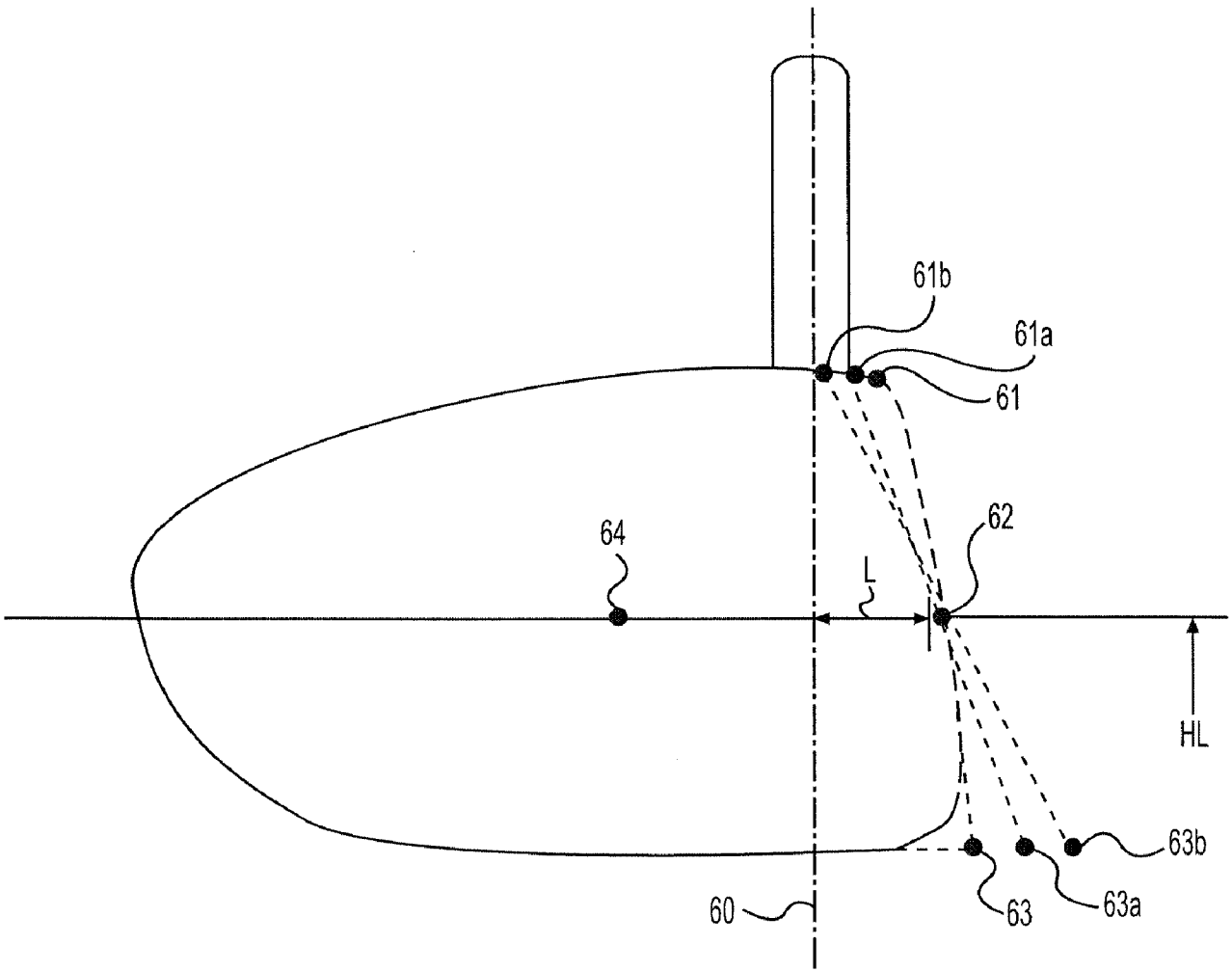
FIG. 6 is a side cross sectional view of a set of golf club heads of the present invention according to an embodiment of the invention.

FIGS. 5 and 6 illustrate another embodiment of the current invention. In particular, FIG. 5 shows a front view of a metal wood golf club 50 that has a face 52, a sole 54, a topline 56, a geometric center of the face 58, a shaft axis 60, an impact point 62, and a center of gravity 64. In this embodiment, the impact point 62 or "sweet spot" for each club in the set is aligned with the center of gravity 64. The "sweet spot" is widely known as the optimum area for hitting a golf ball.

A length L is the horizontal distance from the impact point 62 to the shaft axis 60. The length L is substantially constant for each club in the set. In other words, length L preferably varies by less than about 20 percent for each club in the set (in relation to each specific L). For example, in one embodiment, L varies by less than about 10 percent, preferably less than about 5 percent throughout the clubs in the set. In one embodiment, L varies throughout the clubs in the sets by about 4 percent or less, preferably about 3 percent or less, and more preferably about 2 percent or less. In another embodiment, L varies throughout the set by about 1 percent or less, preferably about 0.5 percent or less, and even more preferably about 0.025 percent or less. In yet another embodiment, L is essentially identical throughout the set, i.e., L varies by less than about 0.01 percent. In this aspect, the ratio of L for a first club in the set to a second club in the set may range, for example, from about 0.90 to about 1.10, preferably from about 0.95 to about 1.05, and more preferably about 0.98 to about 1.02.

In one embodiment, the impact point 62 is located less than about 0.2 inch from a horizontal line HL (see FIG. 6) passing through the face and the center of gravity 64. In another embodiment, the impact point 62 is located less than about 0.15 inch from a horizontal line HL passing through the face and the center of gravity 64. In yet another embodiment, the impact point 62 is located less than about 0.11 inch from a horizontal line HL passing through the face and the center of gravity 64.

As shown in FIG. 6, the distance L between the impact point 62 and the shaft axis 60 is substantially constant. As before, three clubs with varying loft angles are shown in FIG. 6, although more clubs may be included in the set. A first club with the lowest loft angle is represented by the locations on the topline 61, impact point 62, and leading edge 63. A length $L_1$ is the distance from shaft axis 60 to impact point 62 for the first club in the set. A second club with an intermediate loft angle is represented by the locations on the topline 61*a*, impact point 62, and leading edge 63*a*. A length $L_2$ is the distance from shaft axis 60 to the impact point 62 for the second club in the set. A third club with the highest loft angle in the set is represented by the locations on the topline 61*b* impact point 62, and leading edge 63*b*. A length $L_3$ is the distance from shaft axis 60 to the impact point 62 for the third club in the set. The ratios of $L_1$ to $L_2$, $L_2$ to $L_3$, and $L_1$ to $L_3$ are preferably between about 0.90 and about 1.10, more preferably between about 0.95 and about 1.05, and even more preferably between about 0.98 and about 1.02.

Figure 7:
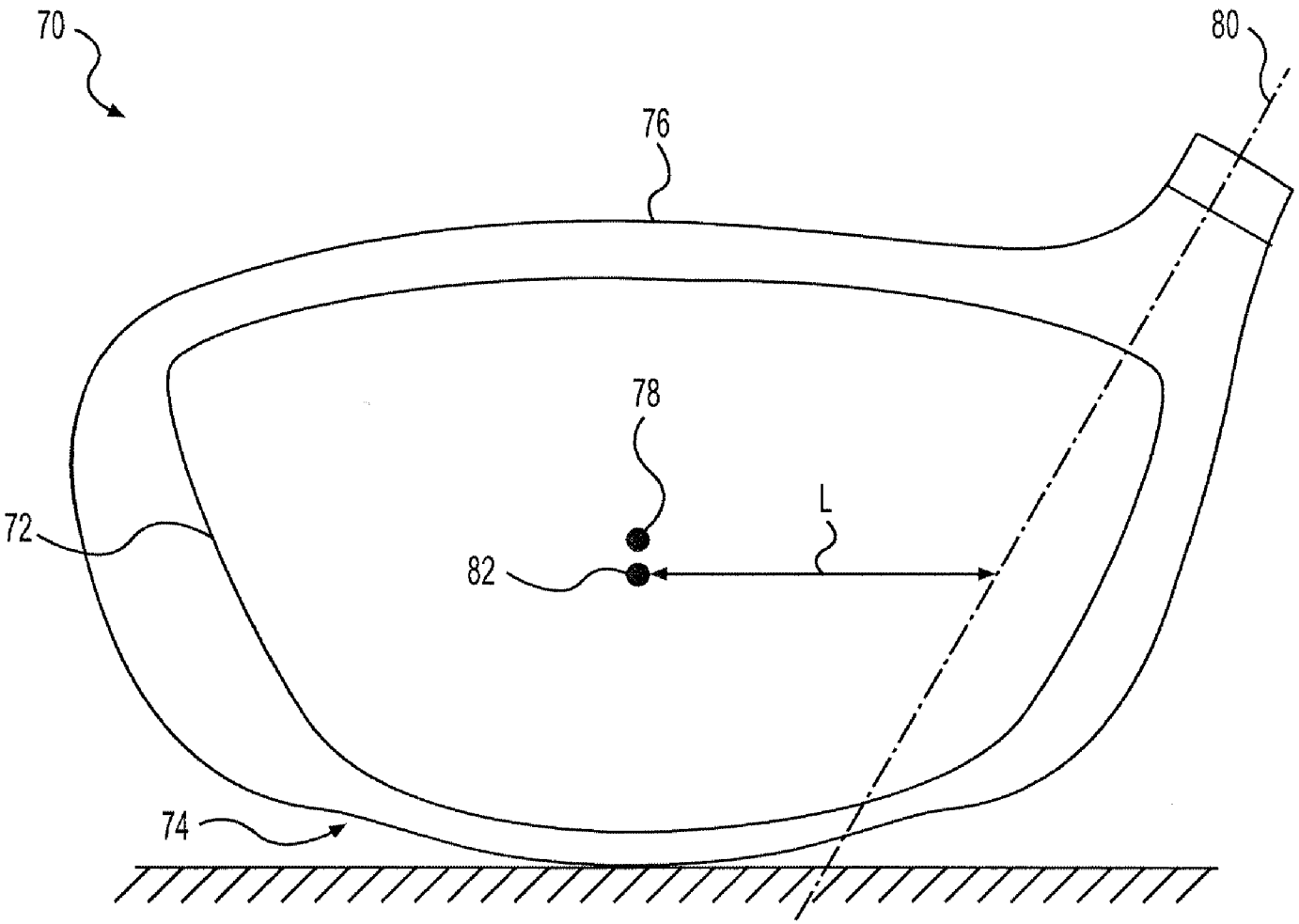
FIG. 7 is a front view of the golf club head of the present invention according to an embodiment of the invention.
Figure 8:
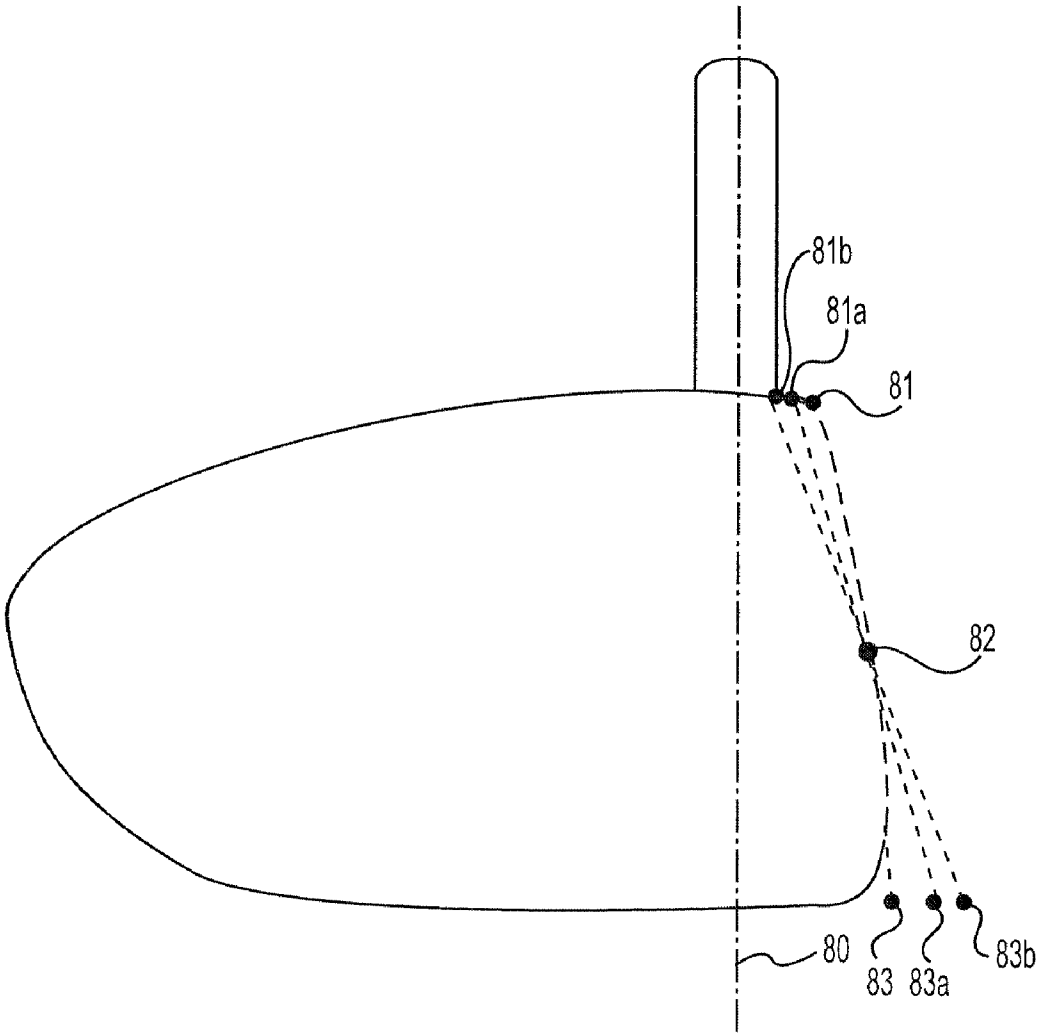
FIG. 8 is a side cross sectional view of a set of golf club heads of the present invention according to an embodiment of the invention.

FIGS. 7 and 8 illustrate another embodiment of the current invention. FIG. 7 shows a front view of a metal wood golf club 70. The club head has a face 72, a sole 74, a topline 76, a geometric center of the face 78, a shaft axis 80, and an impact point 82. In this embodiment, the impact point 82 or "sweet spot" for each club in the set is aligned with the geometric center of the face 78. A length L is the horizontal distance from the impact point 82 to the shaft axis 80. As with previous embodiments, the length L is substantially constant for each club in the set.

For example, as generally shown in FIG. 7, the impact point 82 is aligned vertically with the geometric center of the face 78. In this aspect, the impact point 82 is preferably located less than about 0.2 inch from geometric center of the face 78. In one embodiment, the impact point 82 is located less than about 0.15 inch from geometric center of the face 78 in a vertical direction. In another embodiment, the impact point is located less than about 0.11 inch from geometric center of the face 78 in a vertical direction. As would be understood by a skilled artisan, the vertical variation, may be in a positive or negative z direction. In other words, the impact point 82 may vary slightly in a vertical direction above or below the geometric center of the face 78.

In another embodiment (not shown in FIG. 7), the impact point 82 is aligned horizontally with the geometric center of the face 78. In this aspect, the impact point 82 is preferably located less than about 0.2 inch from geometric center of the face 78. In one embodiment, the impact point 82 is located less than about 0.15 inch from geometric center of the face 78 in a horizontal direction. In another embodiment, the impact point is located less than about 0.11 inch from geometric center of the face 78 in a horizontal direction. As would be understood by a skilled artisan, the horizontal variation, may be in a positive or negative direction with respect to the geometric center of the face 78.

In yet another embodiment, the geometric center of the face 78 and the impact point 82 are substantially similar. In other words, the impact point 82 does not vary in a horizontal or vertical direction from the geometric center of the face 78 by more than about 10 percent. In this aspect of the invention, the club heads of the invention may be designed such that the location of the impact point 82 may vary less than about 5 percent vertically or horizontally from the geometric center of the face.

As further shown in FIG. 8, in this aspect of the invention, the distance between the impact point 82 and the shaft axis 80 is substantially constant. As such, even though this embodiment also has a relationship between the impact point and the geometric center of the face, the distance from the impact point 82 and shaft axis 80 remains substantially constant.

By way of example, three clubs with varying loft angles are shown in FIG. 8, although more clubs may be included in the set. The club with the lowest loft angle is represented by the locations on the topline 81, impact point 82, and leading edge 83. A length $L_1$ is the distance from shaft axis 80 to impact point 82 for the first club in the set. A second club with an intermediate loft angle is represented by the locations on the topline 81*a*, impact point 82, and leading edge 83*a*. A length $L_2$ is the distance from shaft axis 80 to the impact point 82 for the second club in the set. A third club with the highest loft angle is represented by the locations on the topline 81*b*, impact point 82, and leading edge 83*b*. A length $L_3$ is the distance from shaft axis 80 to the impact point 82 for the third club in the set. The ratios of $L_1$ to $L_2$, $L_2$ to $L_3$, and $L_1$ to $L_3$ are preferably between about 0.90 and about 1.10, more preferably between about 0.95 and about 1.05, and even more preferably between about 0.98 and about 1.02.

The club heads in the sets of the invention may be made of a variety of materials. For example, in one embodiment, each club head is made of one or more materials. In particular, part of or all of the club head may be made of ferrous alloy, titanium, titanium alloy, steel, and other metallic materials. A first section may form the face, body and part of the sole. A second section of the club may be composed of one or more low specific gravity material such as bulk molding compound, rubber, urethane, polyurethane, a viscoelastic material, a thermoplastic or thermoset polymer, butadiene, polybutadiene, silicone, and combinations thereof. A third section of the club may be composed of one or more high specific gravity material including tungsten, and a tungsten alloy, including castable tungsten alloys. Preferably, the third section may form the sole and part of the face of the club head. The various materials may be used in certain parts of the club to manipulate the center of gravity, increase the moment of inertia, and dampen vibrations of the club.

In addition, inserts may be utilized in one or more of the clubs in the set. The inserts may be constructed of a high specific gravity material and serve to alter the center of gravity and moment of inertia of the club head. Alternatively, the inserts may be composed of a low specific gravity material and utilized to dampen vibration. The high specific gravity materials preferably have a specific gravity greater than about 5. More preferably, the high specific gravity materials will have a specific gravity that is greater than about 8, and more preferably greater than about 10. Additionally, suitable low specific gravity materials will have a specific gravity that is lower than about 4, preferably lower than about 2, and more preferably lower than about 1.5. The difference in specific gravity of the high specific gravity material and the low specific gravity material is at least about 4, and preferably at least about 7.

As will be understood by those of ordinary skill in the art, the dimensions of the club heads in the set may vary from club to club. For example, one or more clubs may have a face width that is greater than about 4 inches. Preferably, each club in the set has a face width that is at least about 3 inches. Additionally, one or more clubs in the set may have a total depth that is greater than about 4 inches when measured from the face of the club to the back. Preferably, each club in the set has an overall depth that is greater than about 2 inches.

The face height of each club in the set may also vary. One or more clubs may have a face height that is at least about 2 inches. Preferably, one or more clubs has a face height that is at least about 2.5 inches. The ratio of face height to face width for each club in the set is about 0.65 or less. Preferably, the ratio of face height to face width for each club in the set is less than about 0.55.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A set of wood-type golf clubs comprising a plurality of golf clubs, wherein each club in the plurality of golf clubs includes a club head comprising face, a geometric center of the face, an impact point, a topline, a leading edge, a toe, a heel, a sole, a crown, a shaft, and center of gravity, wherein the impact point is located less than about 0.15 inch from the geometric center of the face, wherein each club has a first distance D1 equal to the horizontal distance in the front to back direction between a vertical plane containing a shaft axis and the impact point, wherein the first distance varies by less than about 10 percent for each club in the plurality, wherein each club in the plurality has a different loft angle, and wherein the first distance D1 for each club is not zero.

2. The set of golf clubs of claim 1, wherein the impact point is located less than about 0.20 inch from a horizontal line passing through the face and the center of gravity.

3. The set of golf clubs of claim 2, wherein the impact point is located less than about 0.15 inch from a horizontal line passing through the face and the center of gravity.

4. The set of golf clubs of claim 1, wherein the ratio of the first distance for the first club to the first distance of the second club is between about 0.90 to 1.10.

5. The set of golf clubs of claim 1 wherein the first distance for the first club varies by about 10 percent or less from the first distance of the second club.

6. The set of golf clubs of claim 1, wherein the plurality of golf clubs further comprises a third club having a third loft angle that differs from the first and second loft angles.

7. The set of golf clubs of claim 6, wherein the ratio of the first distance for the first club to the first distance of the third club is between about 0.90 to 1.10.

8. The set of golf clubs of claim 6, wherein the third loft angle is greater than the second loft angle, wherein the second loft angle is greater than the first loft angle, and wherein the ratio of the first distance of the first club to the second club and the ratio of the second club to the third club varies by less than about 10 percent.

9. A set of wood-type golf clubs comprising a plurality of clubs, wherein each club in the plurality includes a club head comprising a face, a geometric center of the face, an impact point, a topline, a leading edge, a toe, a heel, a sole, a crown, a shaft, and center of gravity, wherein the impact point is located less than 0.2 inches from the geometric center of the face, wherein each club has a first distance D1 equal to the horizontal distance in the front to back direction between a vertical plane containing a shaft axis and the impact point of the clubface, wherein the first distance is substantially constant for each club, wherein each of the clubs in the set has a different loft angle, and wherein the first distance D1 for each club is not zero.

10. The set of golf clubs of claim 9, wherein the impact point is located less than about 0.20 inch from a horizontal line passing through the face and the center of gravity.

11. The set of golf clubs of claim 10, wherein the impact point is located less than about 0.15 inch from a horizontal line passing through the face and the center of gravity.

12. The set of golf clubs of claim 9, wherein the ratio of the first distance for the first club to the first distance of the second club is between about 0.90 to 1.10.

13. The set of golf clubs of claim 9, wherein the first distance for the first club varies by about 10 percent or less from the first distance of the second club.

14. The set of golf clubs of claim 9, wherein the plurality of golf clubs further comprises a third club having a third loft angle that differs from the first and second loft angles.

15. The set of golf clubs of claim 14, wherein the ratio of the first distance for the first club to the first distance of the third club is between about 0.90 to 1.10.

16. The set of golf clubs of claim 14, wherein the third loft angle is greater than the second loft angle, wherein the second loft angle is greater than the first loft angle, and wherein the ratio of the first distance of the first club to the second club and the ratio of the second club to the third club varies by less than about 10 percent.

17. A set of wood-type golf clubs comprising a plurality of clubs, wherein each club in the plurality includes a club head comprising a face, a geometric center of the face, an impact point, a topline, a leading edge, a toe, a heel, a sole, a crown, a shaft, and center of gravity, wherein the impact point is substantially similar to the geometric center of the face, wherein each club has a first distance D1 equal to the horizontal distance in the front to back direction between a vertical plane containing a shaft axis and the impact point of the clubface, wherein the first distance is substantially constant for each club, wherein each of the clubs in the set has a different loft angle, and wherein the first distance D1 for each club is not zero.

18. The set of golf clubs of claim 17, wherein the impact point is located less than about 0.20 inch from a horizontal line passing through the face and the center of gravity.

* * * * *